United States Patent [19]

Henderson

[11] Patent Number: 4,874,179

[45] Date of Patent: Oct. 17, 1989

[54] MECHANICAL ROPING DUMMY

[76] Inventor: Tommy L. Henderson, P.O. Box 43, Seadrift, Tex. 77983

[21] Appl. No.: 354,305

[22] Filed: May 19, 1989

[51] Int. Cl.[4] ..... A63B 69/00

[52] U.S. Cl. ..... 273/338

[58] Field of Search ..... 273/338, 339, 359

[56] References Cited

U.S. PATENT DOCUMENTS

| | | | |
|---|---|---|---|
| 3,776,553 | 12/1973 | Kelton | 273/339 |
| 3,802,706 | 4/1974 | Hamm | 273/339 |
| 3,947,033 | 3/1976 | Bennett | 273/339 |
| 4,136,874 | 1/1979 | McCord | 273/339 |
| 4,266,779 | 5/1981 | English | 273/359 |
| 4,286,788 | 9/1981 | Simington et al. | 273/359 |
| 4,364,570 | 12/1982 | Hallam | 273/338 |
| 4,451,045 | 5/1984 | Fesmire | 273/338 |
| 4,498,676 | 2/1985 | Runner | 273/336 |
| 4,640,515 | 2/1987 | Rhine | 273/339 |
| 4,662,642 | 5/1987 | Archibald et al. | 273/339 |

*Primary Examiner*—William H. Grieb

*Attorney, Agent, or Firm*—Munson H. Lane, Jr.

[57] ABSTRACT

A mechanical roping dummy for use in learning and practicing the skills of roping the hind legs of an animal, especially the hind legs of a steer.

16 Claims, 2 Drawing Sheets

MECHANICAL ROPING DUMMY

BACKGROUND OF THE INVENTION

1. Field of the Invention

This invention relates to a mechanical roping dummy for use in learning and practicing the skills of roping the hind legs of an animal, especially the hind legs of a steer.

2. Description of the Prior Art

The roping of the hind legs of a live steer in a rodeo event or other roping contest requires the participant in the roping event to learn and develop roping skills through extensive practice.

The practice of roping skills on a live animal is not always practical because of the stress placed upon the animal with consequent loss of weight and possible injury which would depreciate the market value of the animal.

It is, therefore, desirable to provide a mechanical roping dummy which simulates as closely as possible the movement of the hind legs of the animal so that a person wishing to learn and to practice roping skills may do so without producing wear and tear upon a live animal.

A variety of devices simulating animals, particularly calves and steers, for use in practice roping are disclosed in the prior art represented by the following patents:

U.S. Pat. No. 3,776,553 Kelton: Dec. 4, 1973
U.S. Pat. No. 3,802,706 Hamm: Apr. 9, 1974
U.S. Pat. No. 3,947,033 Bennett: Mar. 30, 1976
U.S. Pat. No. 4,136,874 McCord: Jan. 30, 1979
U.S. Pat. No. 4,266,779 English: May 12, 1981
U.S. Pat. No. 4,286,788 Simington et al.: Sept. 1, 1981
U.S. Pat. No. 4,451,045 Fesmire: May 29, 1984
U.S. Pat. No. 4,640,515 Rhine: Feb. 3, 1987
U.S. Pat. No. 4,662,642 Archibald et al.: May 5, 1987

Most of the prior art devices disclosed in the patents listed above are designed to traverse the ground either by pulling the front end of the device with a rope or by providing a motor or an engine to drive the device over the ground or other surface.

Devices, such as those disclosed in U.S. Pat. Nos. 3,776,553, 3,947,033, 4,136,874 and 4,662,642 which require towing or pulling the device from the front end or head of the simulated animal require that someone other than the person engaged in the practice roping be involved.

U.S. Pat. Nos. 4,266,779 and 4,286,788 disclose the use of an elaborate system of ropes or cables for towing the device. In the case of the device disclosed in U.S. Pat. No. 4,266,779, a rope is attached at one end to the front of the device, is passed around a plurality of pulleys and is connected at its other end to the saddle of a horse on which the participant is riding.

In the case of the device disclosed in U.S. Pat. No. 4,286,788, a bicycle is moved along a rope stretched between two posts by a motor driven endless conveyor. The practice roping device is connected with the bicycle through a system of linkages and is caused to traverse a surface as the bicycle is propelled.

U.S. Pat. Nos. 4,451,045 and 4,640,515 each disclose a roping practice device which is mounted upon a stand which is intended to be stationary relative to the surface on which the stand is supported during the roping practice.

The device disclosed in U.S. Pat. No. 4,640,515 requires that someone other than the person who is practicing roping skills be involved inorder to rope the head of the device and cause motion of the hind legs of the simulated animal.

The device disclosed in U.S. Pat. No. 4,451,045 includes a pair of simulated hind legs which are supported by a rock shaft extending horizontally between bearings mounted on a horizontal frame of a support stand for oscillating motion fore and aft.

The present invention distinguishes from all of the devices mentioned above which require traversing motion of the device over a supporting surface in that it does not require travering movement of the device over a supporting surface. It distinguishes from the device disclosed in U.S. Pat. No. 4,640,515 in that it does not require the active participation of anyone other than the person practicing his roping skill for operation of the device. It distinguishes from the device disclosed in U.S. Pat. No. 4,451,045 in the type of motion involved as well as in significant structural features of the device.

SUMMARY OF THE INVENTION

It is an object of the invention to provide a mechanical roping dummy for use in learning and practicing roping skills by an individual participant without involving the active participation of anyone else.

It is a further object of the invention to provide a mechanical roping dummy which is simple in construction, has few parts, which has a stable supporting stand which does not have to be anchored down and which won't overturn when roped.

It is still a further object of the invention to provide a mechanical roping dummy having a pair of hind legs, simulating the hind legs of a calf, steer or other animal which are pivotally mounted on a horizontal pivot at one end of a vertically oscillatable bar whose other end is pivotally mounted on a first upright frame of a stand which includes a base and a second upright frame extending upwardly from the base which guides the oscillatable bar in its oscillation in a substantially vertical plane, and a motor and connecting drive means for oscillating the bar upon energizing the motor to cause up and down motion of the pair of hind legs.

It is a further object of the invention to provide resilient bias means for biasing the hind legs of the device in a forward direction and to provide means for limiting the rearward motion of the hind legs when the legs are roped.

With the foregoing objects and features in view and such other objects and features as may become apparent as this specification proceeds, the invention will be understood from the following description taken in conjunction with the accompanying drawings wherein like characters of reference are used to designate like parts.

DESCRIPTION OF THE PREFERRED EMBODIMENT

Figure 1:
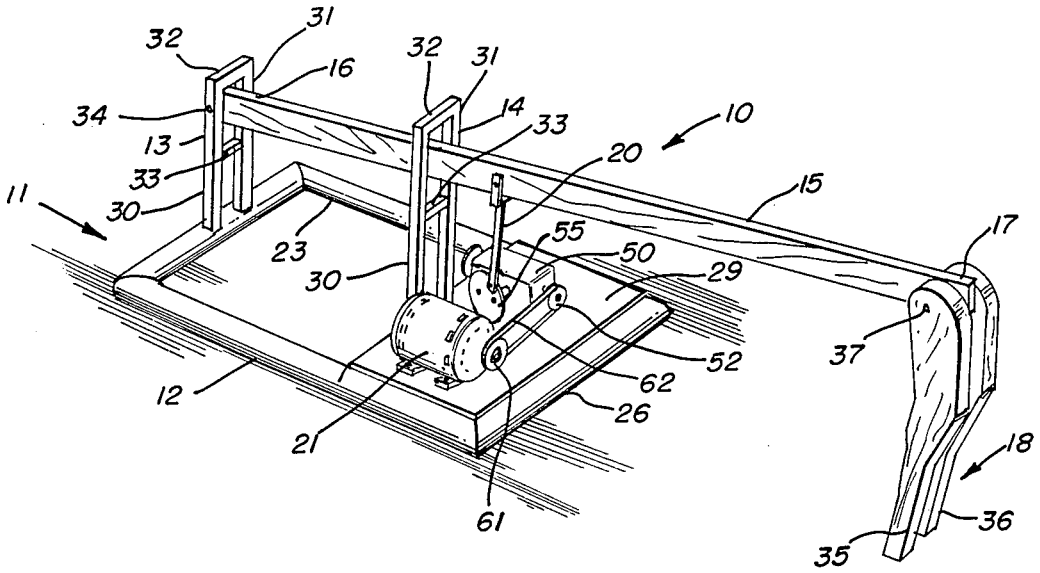
FIG. 1 is an overall perspective view of the invention.

The mechanical roping dummy of the present invention is indicated generally by the reference numeral 10. The roping dummy comprises a portable stand 11 including a base 12 and first and second upright frames 13 and 14 respectively which are rigidly secured to the base 12 and are spaced in fore and aft alignment with respect to the base. An elongated bar 15 is pivotally mounted at one end 16 to the first upright frame 13 for oscillation in a vertical plane. The bar 15 extends rearwardly over and beyond the base 12 and it is guided in vertical oscillation by the second upright frame 14. Pivotally attached to and depending from the rear end 17 of the bar 15 are a pair of hind legs 18 which are shaped to resemble the hind legs of an animal such as a steer. The hind legs 18 are biased forwardly by resilient biasing means 19. A drive arm 20 is pivotally connected to the elongated bar and is driven by a motor 21 mounted on the base 12 through suitable drive means 22 to oscillate the elongated bar 15.

The base 12 as shown is preferably a flat rectangular base comprised of an outer rectangular frame 23 of tube sections 24, 25, 26 and 27 with ends welded together in series. An intermediate tube section 28 is welded to the side sections 25 and 26 for bracing of the frame 23 as well as for providing support to one edge of a flat rectangular plate 29 welded to and covering the rear portion of the base frame 23.

The first and second upright frames 13 and 14 are of similar construction, however, the second frame 14 is taller than the first. Each of the frames 13 and 14 comprise a pair of laterally spaced upright posts 30 and 31 of equal length and a horizontal top member 32 rigidly connecting the upper ends of the posts 30 and 31. The bottom ends of the posts 30 and 31 are welded or otherwise rigidly secured to the base 12. As shown the first upright frame 13 is rigidly secured to the top of the tubular frame section 24 at the front of the base 12, and the second upright frame 14 is secured to the top of the intermediate section 28, or to the top of plate 29 as may be preferred. Each of the frames 13 and 14 also have a transverse brace 33 rigidly secured between the upright posts 30 and 31 intermediate the top and bottom ends of the posts and below the bar 15. The spacing between the posts 30 and 31 is slightly greater than the width of the bar 15 to permit free oscillation of the bar therebetween, however, the posts 30 and 31 are close enough to act as vertical guides for the bar 15 in its vertical oscillation. A pivot 34 extending through the posts 30 and 31 and through the forward end portion 16 of the bar 15 provides a pivoted connection between the bar 15 and the first upright frame 13.

The pair of hind legs 18, comprising individual legs 35 and 36, are pivotally connected by a pivot pin 37 extending through the upper end portions thereof to the rear end portion 17 of the bar 15. Spacer blocks 38 and 39 secured to the inside surfaces of the individual legs 35 and 36 are provided between the legs 35 and 36 and the bar 15. The legs 35 and 36, the spacer blocks 38 and 39 and the elongated bar 15 are preferably made of wood or other light weight material with sufficient strength to endure the stress to which the parts are subjected when the roping dummy is in use. A tubular cross piece 40 is bolted between the legs 35 and 36 beneath the bar 15 by a bolt 41 extending through the legs and the cross-piece 40 so that both legs move together.

The resilient means 19 biasing the pair of legs 18 forward comprises a coil spring having one end attached beneath the bar 15 and its other end attached to the cross-piece 40.

A means 42 for limiting the motion of the pair of legs 18 comprises a flat bar mounted between the bottom of the elongated bar 15 and connecting the cross-piece 40. The bar 42 includes a front portion 42 having an elongated slot 44 therein, which is secured beneath the bar 15 by means of a screw 46 extending through the slot 44 into the bar 15, and a downwardly angled rear portion 45 which is welded to the cross-piece 40.

Figure 2:
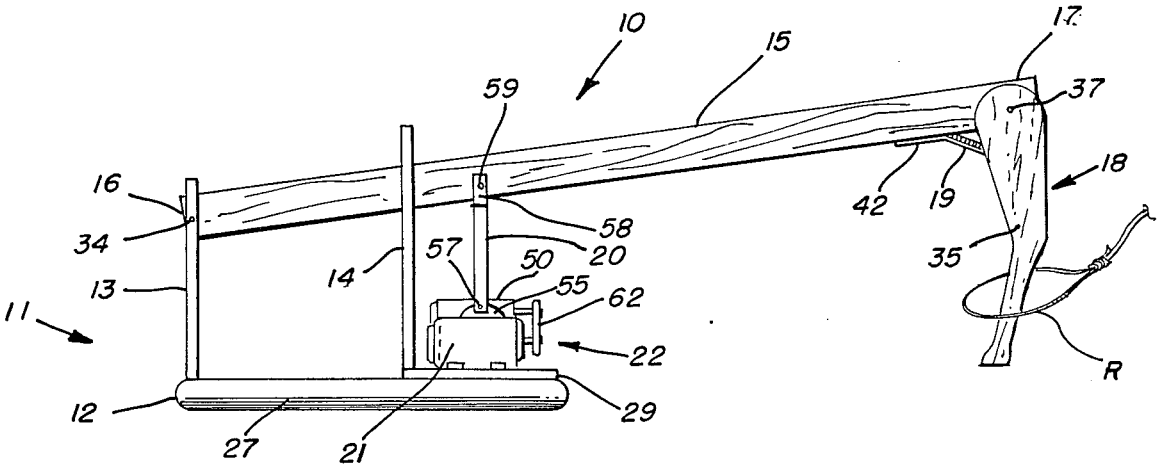
FIG. 2 is a right-side elevational view of the invention shown in FIG. 1.
Figure 3:
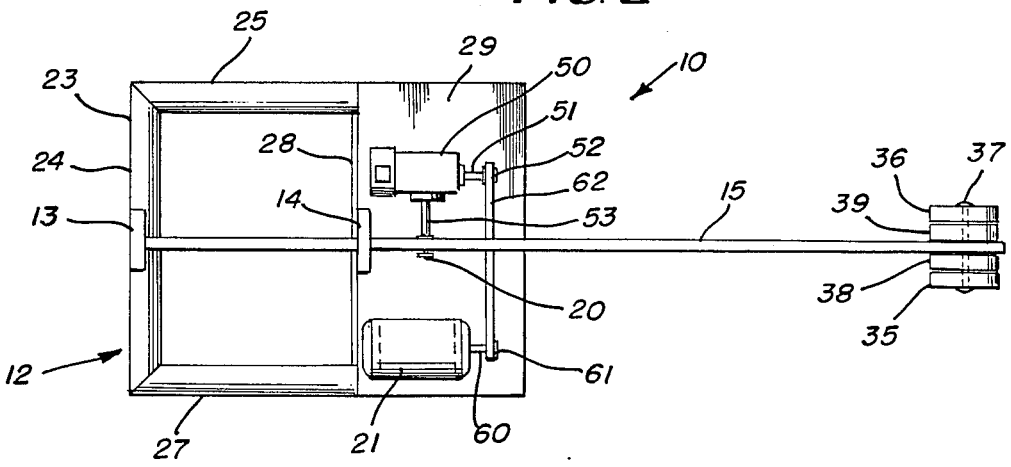
FIG. 3 is a top plan view of the invention shown in FIG. 1.
Figure 4:
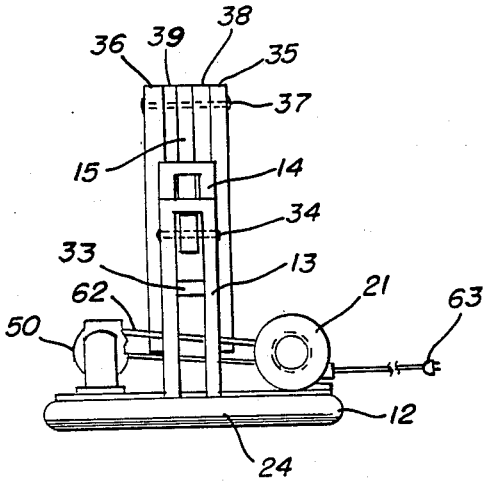
FIG. 4 is a front elevational view of the invention shown in FIG. 1.
Figure 5:
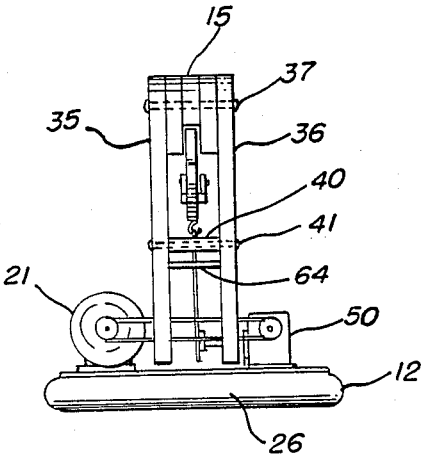
FIG. 5 is a rear elevational view of the invention shown in FIG. 1.
Figure 7:
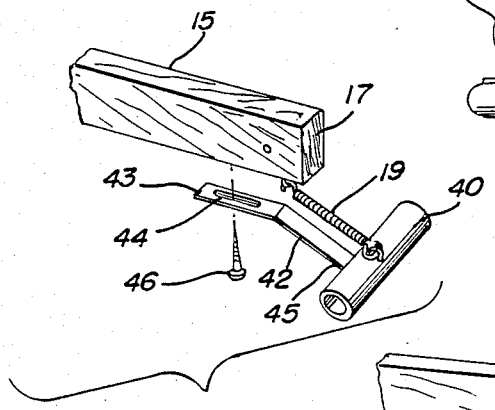
FIG. 7 is a partial exploded perspective view showing the slot in the rear of the motion limiting brace for the hind legs which allows the spring to absorb some of the shock when the hind legs are roped.
Figure 6:
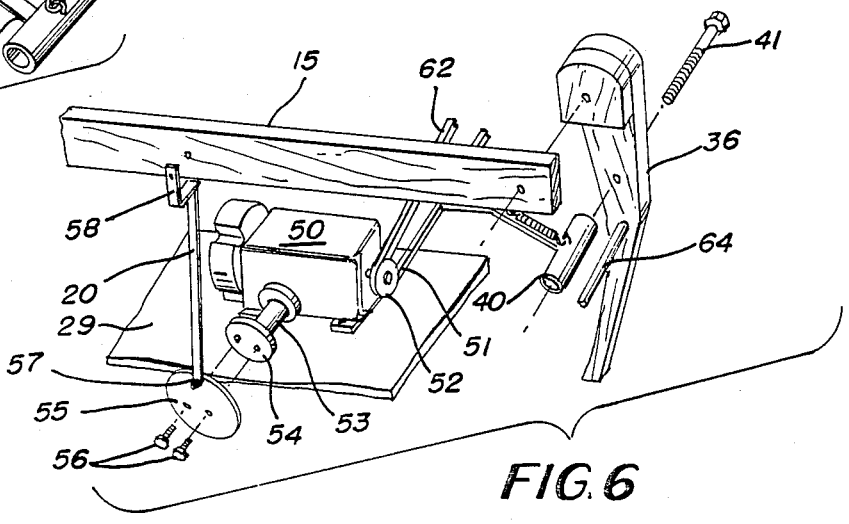
FIG. 6 is an exploded perspective view of a portion of the invention showing how the hind legs attach to the support bar, the motion limiting brace, and forward biasing spring.

The drive means 22 connecting the motor 21 with the drive arm 20 includes a gear box 50 having an input shaft 51 on which a pulley 52 is mounted and an output shaft 53 with a circular disk 54 secured to the end thereof. A circular plate 55 is secured to the disk 54 by bolts 56,56 extending through apertures in the plate 55 and screwed into threaded bores in the disk 54. One end of the drive arm 20 is pivotally connected to the plate 55 by a pivot pin 57 eccentrically mounted on the plate 55. A yoke 58 at the upper end of the drive arm 20 is pivotally connected to the bar 15 by a pivot 59 (FIG. 2). The electric motor 21 has a driveshaft 60 on which a drive pulley 61 is mounted. A belt 62 extends around the drive pulley 52 and the pulley 52 on the input shaft 51 of the gear box 50 for driving the gear box input shaft when the motor 21 is energized by connecting the electric plug 63 (FIG. 4) to a source of electric power (not shown). The gear box 50 comprises reduction gearing for rotating the plate 55 at a relatively slow rate compared to the speed of the motor 21 so that the bar 15 is oscillated by the up and down motion of the drive arm 20 at a speed corresponding generally with the kicking motion of a steer.

It will be apparent that different means may be employed to vary the speed of the oscillation of the bar 15 to approximate the actual speed of the motion of a live steer. For example, an adjustable speed motor or an adjustable speed gear box may be used separately or in combination and the speed of same may be selected to obtain the desired speed for the plate 55. If a fixed speed motor and a fixed speed gear box are used, then the output speed may be changed by changing the diameter of the drive pulley 61 and/or the diameter of the driven pulley 52. Any of the aforesaid speed changing devices, or any other means for varying the speed at which the elongated bar 15 is oscillated to simulate the speed of motion of a live steer may be used within the scope of this invention.

The height to which the hind legs 18 are lifted relative to the ground may also be varied by various means within the scope of the invention. One way would be to have a series of holes extending radially from the center of the plate 55 so that the throw of the drive arm 20 may be varied by changing the hole through which the pivot pin 57 extends.

In operation, the person wishing to practice roping starts the mechanical roping dummy 10 by plugging the electric plug 63 connected to the electric motor 21 into a source of electric power. The motor 21 thus becomes energized and rotates the drive pulley 61. The drive pulley 61 drives the belt 62 which rotates the pulley 52 keyed to the input shaft of the reduction gearing 50. The reduction gearing 50 rotates the circular plate 55 which is secured to the reduction gearing output shaft 53. As the plate 55 is rotated, the drive arm 20, which is pivoted at one end to the plate 55 by an eccentric pin 57, moves up and down and in turn drives the bar 15 in vertical oscillation about the pivot pin 34 extending through the first (or front) upright frame 13. The pair of hind legs 18 which are pivoted at the rear end 17 of the bar 15 move up and down with each oscillation of the bar 15. The person practicing roping watches the up and down motion of the pair of hind legs 18 and times the release of a rope R with noose to lasso the hind legs when the hind legs are in a raised position (see FIG. 2).

The up and down motion of the hind legs 18 will teach the person practicing roping to get in time with the motion of a steer or other animal to lasso the back feet as they move up instead of trapping them. The hind legs will preferrably rise about eleven and one-half inches off the ground.

While in the foregoing there has been described and shown a preferred embodiment of the invention, various modifications and equivalents may be resorted to within the spirit and scope of the invention as claimed.

What is claimed is:

1. A mechanical roping dummy for use in practice roping comprising a stand having a base and first and second upright frames rigid with said base and spaced respectively in fore and aft alignment thereon, an elongated bar pivotally mounted at one end on said first upright frame for oscillation in a vertical plane and being guided in its vertical oscillation by said second upright frame, said bar overlying said base with its other end extending rearwardly beyond the base, a pair of legs resembling the hind legs of an animal pivotally mounted on the rearward end of said bar and depending therefrom, each leg being on an opposite side of said bar from the other leg, resilient means extending between said bar and said legs for biased said legs in a forward direction, a drive arm pivotally connected to said bar between the ends thereof for moving said bar in vertical oscillation, a motor mounted on said base, and means driven by said motor for driving said drive arm to oscillate said bar.

2. The mechanical roping dummy of claim 1 wherein there is a first crosspiece extending between the legs of said pair of legs and means for rotatably mounting said first crosspiece between said legs.

3. The mechanical roping dummy of claim 2 wherein said resilient means comprises a tension spring connected between said elongated bar and said first crosspiece.

4. The mechanical roping dummy of claim 2 together with means for limiting the pivotal motion of said hind legs connected between said elongated bar and said first crosspiece.

5. The mechanical roping dummy of claim 4 wherein said elongated bar has an underside and wherein said means for limiting the pivotal motion of said hind legs comprises a flat bar having a first portion slidably mounted on the underside of said elongated bar and a second portion angled downwardly from said first portion and rigidly connected to said first crosspiece, said first portion of said flat bar having an elongated slot therein extending longitudinally of said first portion, said slot having opposite ends and connecting means extending through said slot into the underside of said elongated bar for slidably connecting said first portion of said flat bar to the underside of said elongated bar, said elongated slot limiting the sliding motion of said flat bar relative to said elongated bar by contact of said connecting means with the opposite ends of said slot.

6. The mechanical roping dummy of claim 5 wherein said resilient means comprises a tension spring connected between said elongated bar and said first crosspiece.

7. The mechanical roping dummy of claim 2 wherein there is a second crosspiece rigidly connected between the legs of said pair of legs below said first crosspiece.

8. The mechanical roping dummy of claim 1 wherein said motor is a rotary motor having an output shaft, and wherein said means driven by said motor for driving said drive arm comprises reduction gearing having an input shaft and an output shaft, a pulley mounted on said reduction gearing input shaft for driving said input shaft, a belt extending around the drive pulley of said motor and around the pulley on the input shaft of said reduction gearing for driving said reduction gearing when the motor is actuated, a plate mounted on the output shaft of said reduction gearing and rotatable therewith, and eccentric means pivotally connecting said drive arm with the plate mounted on the output shaft of said reduction gearing for moving said drive arm up and down with each revolution of said plate.

9. The mechanical roping dummy of claim 8 wherein said motor is an electrical motor.

10. A mechanical roping dummy for use in practice roping comprising a stand having a base and first and second uprights rigid with said base and spaced respectively in fore and aft alignment thereon, an elongated bar pivotally mounted at one end on said first upright for oscillation in a vertical plane and being guided in its vertical oscillation by said second upright, said bar overlying said base with its other end extending rearwardly from said first upright, a pair of legs resembling the hind legs of an animal pivotally mounted on the rearward end of said bar and depending therefrom, each leg being on an opposite side of said bar from the other leg, a drive arm pivotally connected to said bar between the ends thereof for moving said bar in vertical oscillation, a motor mounted on said base, and means driven by said motor for driving said drive arm to oscillate said bar.

11. The mechanical roping dummy of claim 10 together with resilient means extending between said bar and said hind legs for biasing said legs in a forward direction.

12. The mechanical roping dummy of claim 11 together with means for limiting the pivotal motion of said hind legs to a predetermined angle between a forward extreme and a rearward extreme.

13. The mechanical roping dummy of claim 10 wherein said first and second uprights comprise a pair of parallel horizontally spaced upright posts having top and bottom ends, the bottom ends of said posts being rigidly secured to said base and the top ends of said posts being rigidly connected by a transverse top member, said elongated bar being pivotally mounted at said one end between the parallel posts of said first upright and extending between the parallel posts of said second upright, the spacing between posts being sufficient to permit free oscillation of said elongated bar therebetween while guiding the elongated bar for oscillation in a substantially vertical plane.

14. The mechanical roping dummy of claim 13 wherein said parallel posts of said second upright are taller than the parallel posts of said first upright.

15. The mechanical roping dummy of claim 10 wherein said base comprises a rectangular frame having a front edge and a rear edge, with said first upright mounted adjacent said front edge and with said second upright mounted rearwardly of said first upright intermediate said front and rear edges.

16. The mechanical roping dummy of claim 15 wherein said base has a plate covering the rear portion of said rectangular frame with said motor mounted on said plate.

* * * * *